US005549273A

United States Patent [19]

Aharon

[11] Patent Number: 5,549,273

[45] Date of Patent: Aug. 27, 1996

[54] ELECTRICALLY OPERATED FAUCET INCLUDING SENSING MEANS

[76] Inventor: Carmel Aharon, Kibbutz Glil Yam, Israel

[21] Appl. No.: 215,740

[22] Filed: Mar. 22, 1994

[30] Foreign Application Priority Data

Mar. 22, 1993 [IL] Israel ..... 105,133

[51] Int. Cl.[6] ..... F16K 31/02

[52] U.S. Cl. ..... 251/129.04; 251/30.05

[58] Field of Search ..... 251/30.01, 30.02, 251/30.05, 129.04

[56] References Cited

U.S. PATENT DOCUMENTS

| | | | |
|---|---|---|---|
| 4,762,273 | 8/1988 | Gregory et al. | 251/129.04 |
| 4,788,998 | 12/1988 | Pepper et al. | 251/129.04 |
| 4,872,485 | 10/1989 | Laverty, Jr. | 251/129.04 |
| 4,894,874 | 1/1990 | Wilson | 251/129.04 |
| 4,921,211 | 8/1990 | Novak et al. | 251/129.04 |
| 4,995,585 | 2/1991 | Gruber et al. | 251/30.01 |
| 5,033,715 | 7/1991 | Chiang et al. | 251/129.04 |
| 5,063,622 | 11/1991 | Tsutsui et al. | 251/129.04 |
| 5,243,717 | 9/1993 | Pasuo | 251/129.04 |

*Primary Examiner*—A. Michael Chambers
*Attorney, Agent, or Firm*—Abelman, Frayne & Schwab

[57] ABSTRACT

An electronically operated assembly to be used in conjunction with water faucets is provided with a sensor that senses the presence of objects such as human hands and automatically starts the flow of water. The water flow automatically stops when the object is removed from the faucet vicinity. An electronically automated assembly for water faucets comprises a water flow control valve and a small size electric motor adapted to operate the water flow control valve via a transmission gear and an infrared sensing device connected to a source of electric power adapted to activate or disconnect the electric motor.

12 Claims, 10 Drawing Sheets

ELECTRICALLY OPERATED FAUCET INCLUDING SENSING MEANS

FIELD AND BACKGROUND OF THE INVENTION

The present invention relates to an electronically operated assembly to be used in conjunction with water faucets provided with sensing means that sense the presence of objects such as human hands and automatically start the flow of water. The water flow automatically stops when said object is removed from the faucet vicinity.

Automatic electrical or electronically operated faucets have been known for many years. There are a relatively large number of patents relating to such devices and systems such as U.S. Pat. Nos. 4,921,211, 4,872,485, 4,894,874 and 4,762,273; a fairly large number of other patents are cited in the above mentioned patents. These patents differ from each other by all kinds of features, such as the structure thereof or the operating method and components.

Several of the above mentioned patents are based on a passive infra-red (thermal) receiver sensitive to the temperature of a nearby object, others use ultrasonic techniques and electro-optical mechanisms incorporating Light Emitting Diodes (LED's) and Si-based detectors.

The present invention uses an electro-optical method and electro-mechanical apparatus that overcomes the deffiencies associated with prior art solution:

a) All other known methods do not afford execution of the various tasks required in dishes cleaning basins, like: filling a glass, saponification of a pot without water flow, cleaning the basin and washing hands.

b) The reflection of IR light from black objects is very weak. A conventional electro-optical proximity sensing system is thus either insensitive to black bodies or having a large dynamic range leading to susceptibility to false alarms.

c) Another problem associated with prior art electro optical automatic faucets is the fact that they are not sensitive to specular objects like a polished knife.

d) Previous methods yield a relatively high percentage of false alarms, i.e. water flow activation due to "false" objects like a nearby hand or a pile of dished in the basin.

e) Most prior art methods use network power to feed the electro-mechanical module and their design does not minimize power consumption.

f) The mechanical part and activation mechanism differes from other patents in the fact that there is no use of a solenoid to activate the valve but by an electric motor and by the mechanical transmission which need very little energy than which is required by a solenoid.

Furthermore, the opening for the release of pressure which holds the diaphragm of the main valve is achieved by a pilot valve which is not connected directly to the diaphragm. In order to obtain the pressure in the known valves a metal rod and spring is provided within the water which usually is affected by corrosion, which is not the case in the embodiment according to the invention.

OBJECTS OF THE PRESENT INVENTION

It is the main object of the present invention in its broadest aspect to provide a self contained, battery operated, electro-mechanical assembly equipped with electro-optical proximity sensing means to be used in conjunction with water faucets to automatically control the water flow and to be free of all the defficiences described above, associated with prior art assemblies.

It is a further object of the present invention to provide an electronically operated assembly to be used with faucets of all kinds and which would have a wide operational angle.

It is a further object of the present invention to provide such a system which will not be affected by the water stream discharge from the outlet.

It is yet a further object of the present invention to provide a faucet with an unique mechanism in particular the employment of an electric motor for operating the valve.

The electric and electronic circuits operate on the known principle that an object such as hand enters the zone near the faucet, reflects to a light detector part of the beams projected by a plurality of I.R. LED's. These beams are projected in short pulses, the wave length of which is the near infra red. When the detector receives such pulses a signal is sent to the micro processor (MCU). The MCU performs an algorithm in order to ascertain the presence of the object by generating such pulses and verification thereof. In accordance with the results, the MCU activates the motor which opens or closes the faucet.

In order to save energy as much as possible, the MCU is in a "sleepy" state most of the time. The pulses are generated by an oscillator (OSC) which requires very little current. The MCU is put in action only after the presence of an object is detected. Also the receiver and the comparator do not receive current permanently but only a short while before the pulse is generated. In such a manner energy is saved to a large extent. The motor is activated by means of a short pulse and during the rest of the time no current is supplied.

In order to avoid and to limit the false activation a comparison is performed between the generated pulse and the received pulse.

SUMMARY OF THE INVENTION

According to the invention there is provided an electronically automated assembly for water faucets comprising a water flow control valve and a small size electric motor adapted to operate said valve via a transmission gear and an infrared sensing means connected to a source of electric power adapted to activate or disconnect said electric motor.

The assembly further comprises a water inlet, a water outlet, a seal for the main valve, windows for infrared transmitters and receivers, diaphragm of rubber and a rear pressure chamber and an inner cylinder for pilot valve, mechanical transmission and a seal for the motor. Said assembly could be placed within a housing which forms part of the faucet or mounted within the faucet.

According to the first embodiment the assembly and the infrared transmitter and receiver are mounted in a housing being part of the faucet. Due to the lateral separation between the transmitter and receiver a geometrical overlap zone is defined and only objects that penetrate into this zone will activate the water flow.

According to the prefered embodiment the infrared sensing means being a light Emitting Diode (LED) or a plurality of LED's with emitting lenses are installed on the spout and a receiver equipped with an objective lens is mounted in the housing or the spout in a manner which keeps the separation of transmitter and receiver.

The radiation conus and the receiver field-of-view define an overlap volume such that only objects inside this volume will scatter light into the receiver and activate the faucet.

In order to define a large activation volume and to still maintain a strict geometrical definition of this activation zone a plurality of LEDs and a plurality of receivers are used to geometrically cover the required zone.

By employing the above embodiments the system could be used in different modes of operation as follows:

Automatic Mode

In this mode of operation an object inserted into the activation zone triggers the water flow. When this object is removed from the activation zone the water flow stops. This is the "normal" operation mode applicable for hand and dish washing.

Semi-Automatic Mode

In this mode an object inserted into the activation volume activates the water flow as above. The water flow does not stop when the object is removed from the zone. In order to stop the water flow object must penetrate the activation zone for the second time. This "on/off zone" may be localized in a region that is usually not accessible when performing usual dish washing tasks. The semi automatic mode of operation is required when handling black or specular objects or when soaping the dishes or cleaning the basin.

The most prefered embodiment employs a combination of the two above mentioned modes.

Usually both automatic and semi-automatic modes of operation are required for every faucet installed in a kitchen basin and sometimes in bath basins as well. The automatic mode is activated in the course of a hand or dish washing activities, the semi-automatic modes is chosen while saponizing dishes, cleaning the basin or washing black or specular dishes.

A special distinction between the activation zones for the two modes of operation is implemented: the volume beneath the spout outlet is used as the "automatic zone" while the volume near the faucet is used as the "semi-automatic" zone.

The system distinguishes between the two modes using one of the following means:

a. Separate LED—receiver a couple for each zone.
b. A common detector or a plurality of common detectors for the two zones and LEDs that have different pulse rates for each zone.
c. A common detector or a plurality of common detectors and LEDs that have identical pulse frequency. After dectecting a first echo the MCU activates the two (or more) LEDs sequentially and thus identifies the zone that has been activated.

SHORT DESCRIPTION OF THE DRAWINGS

The invention will now be described with reference to the annexed drawings in which.

Figure 1:
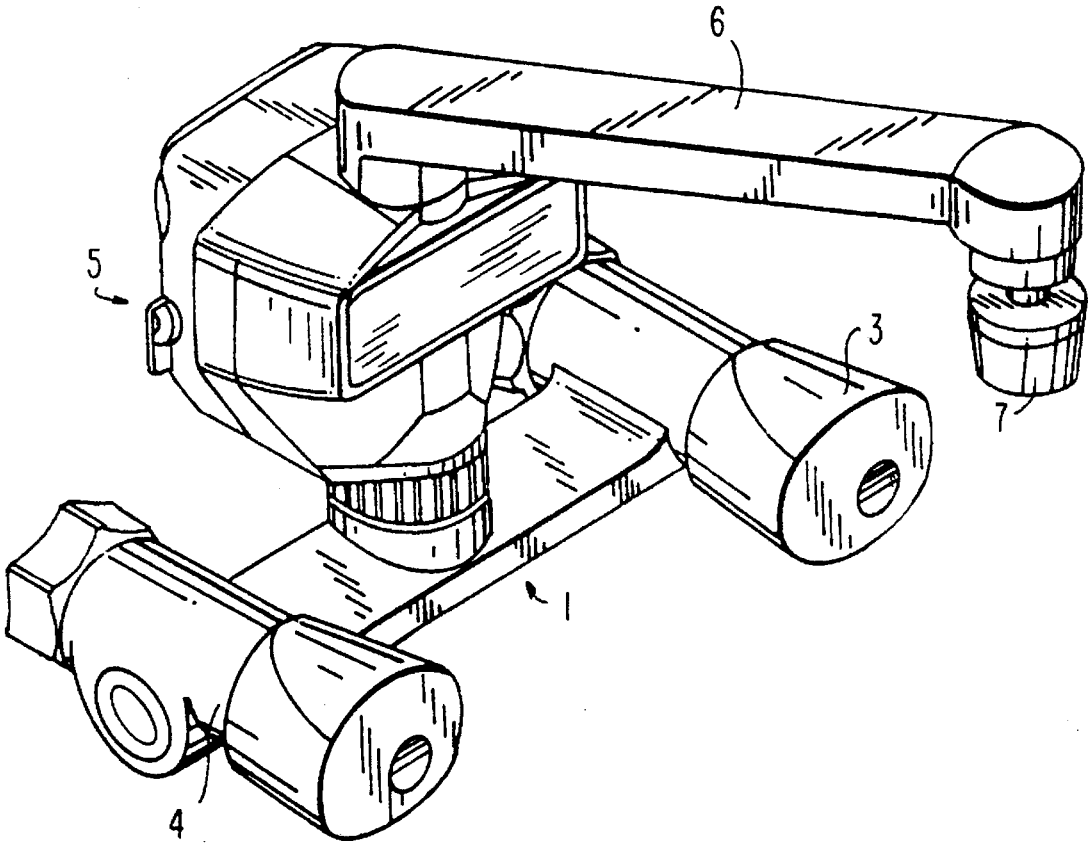
FIG. 1 is perspective illustration of a faucet provided with an assembly according to the invention.
Figure 2:
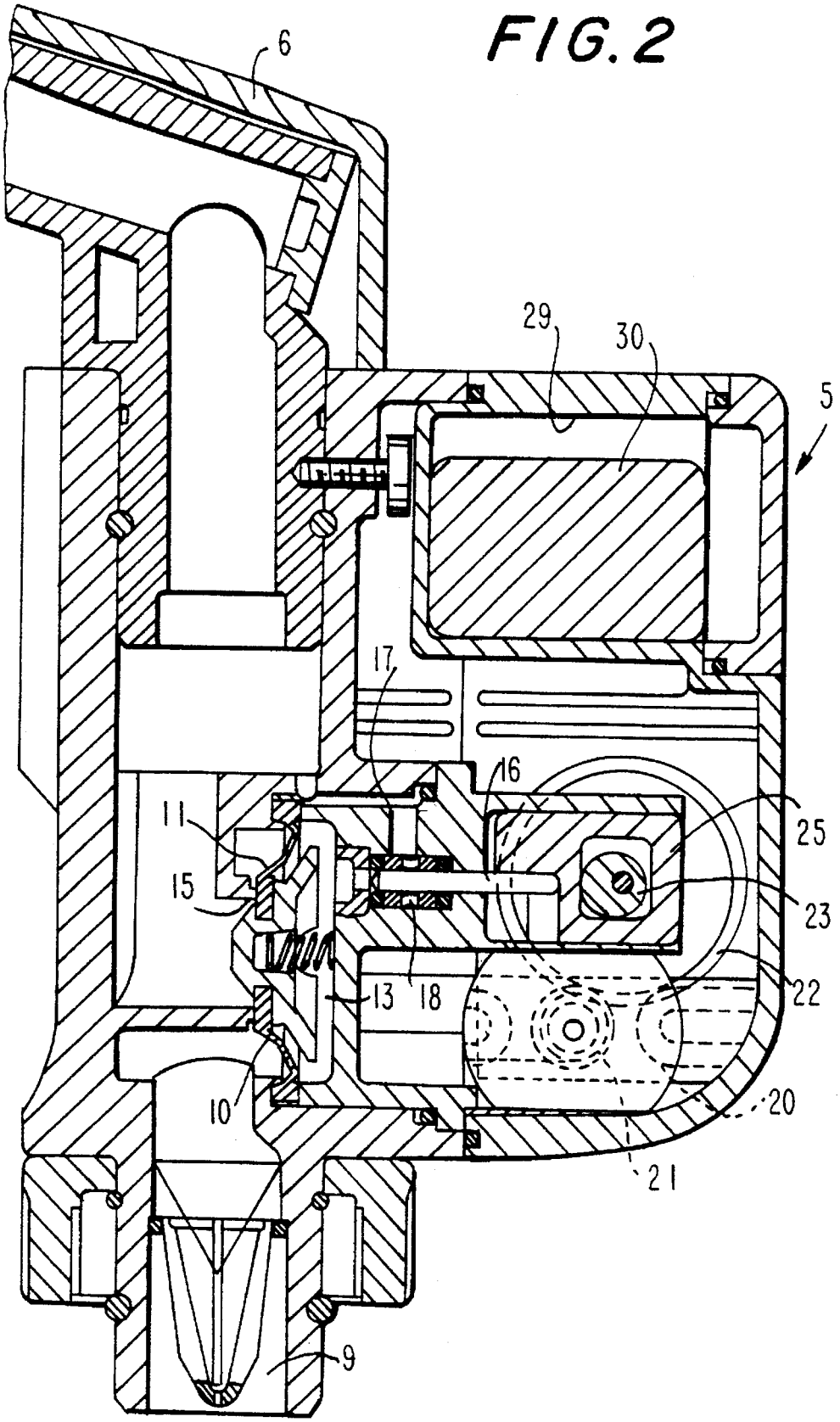
FIG. 2 is a longitudinal cross section of the faucet.
Figure 3:
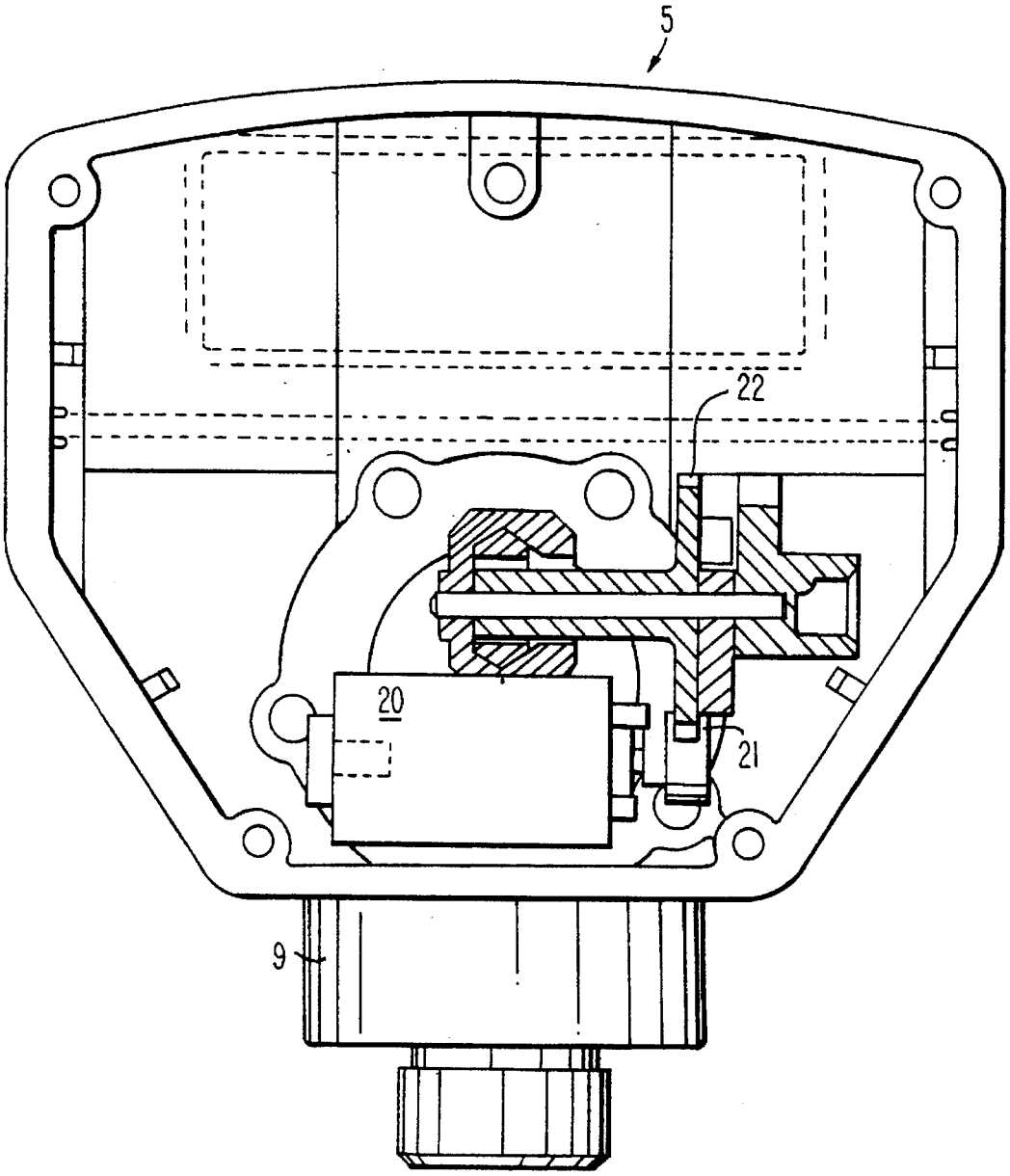
FIG. 3 is a rear partly in cross section, of the assembly.
Figure 4:
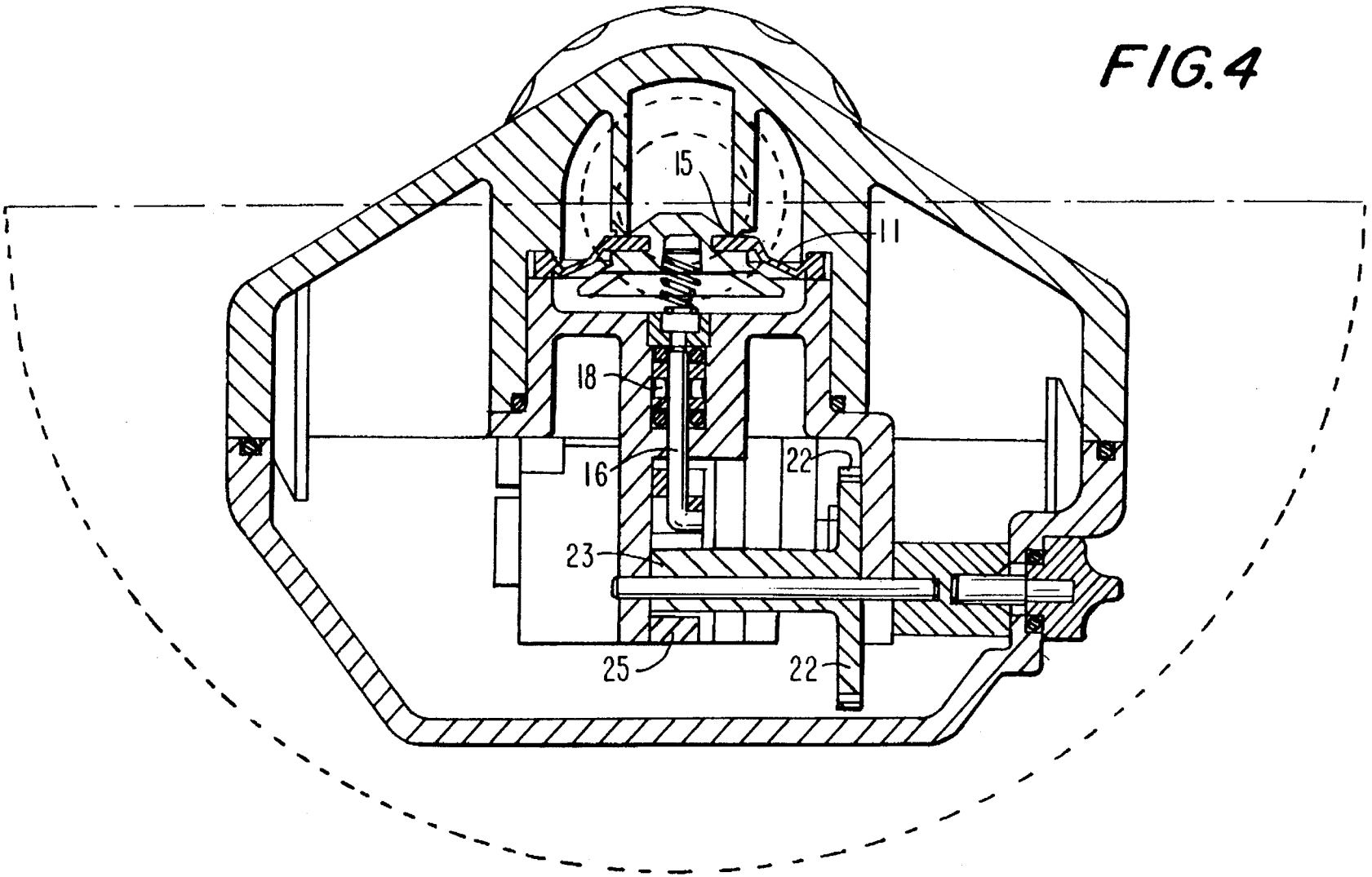
FIG. 4 is a top upper part partly in cross section, of the assembly.

Turning first to FIG. 1 illustrating a mixing battery 1 having hot and cold taps 3 and 4 a box like body 5 on top of which is mounted a spout 6 and water outlet 7. As can be seen in FIG. 2, 3 and 4.

Water pressure at the inlet 9 of the mixing battery 1 passes through an aperture 10 in a diaphragm 11, into a the rear pressure chamber 13 and causes the diaphragm to be secured to its seat 15 preventing the water passage, to spout 6. The release of the pressure from the rear pressure chamber 13 is performed by means of a pilot valve 14 and pressure relief channels 17 which cause the pressure at the inlet 9 to be higher than the one at the rear pressure chamber 13, hence the diaphragm 11 will rise from its seat and open the passage for the water to the spout 6.

Mechanically the pilot valve 14 is activated via stem 16 by means of a small electric motor 20, on which is keyed a gear 21 which mash with 22 and the excenter 23 which are keyed on axis 24.

The excenter 23 is mounted within a follower 25 which transforms the reloving of the excenter 23 to forward and backwards linear movement. The pilot valve 14 is connected to the follower 25 via stem 16 thus moves along side the follower so that the forward movement causes it to enter into the water passage 18 and consequently its blocking, while its backward movement causes its retrieving from the water passage 18 and the opening thereof, thus releasing the pressure from chamber 13. A 9V battery 30 is placed in compartment 29 supplies electric power to the motor and the electronic part (to which reference will be made).

The revolving of the motor in two directions as required is created by the changing of polarity.

In order to nutralize the automatic operation of the valve when so required knob 51 which is connected to the free end of axis 24 is turned thus it would bring pilot valve to its "open" position. At the same time a member 53 being part of knob 51 would turn. A magnet 54 is mounted within member 53 and in line with a switch 55. Switch 55 being part of the electric circuit of the assembly, thus the turning of knob 51 would bring said switch to its "break" position.

Figure 5:
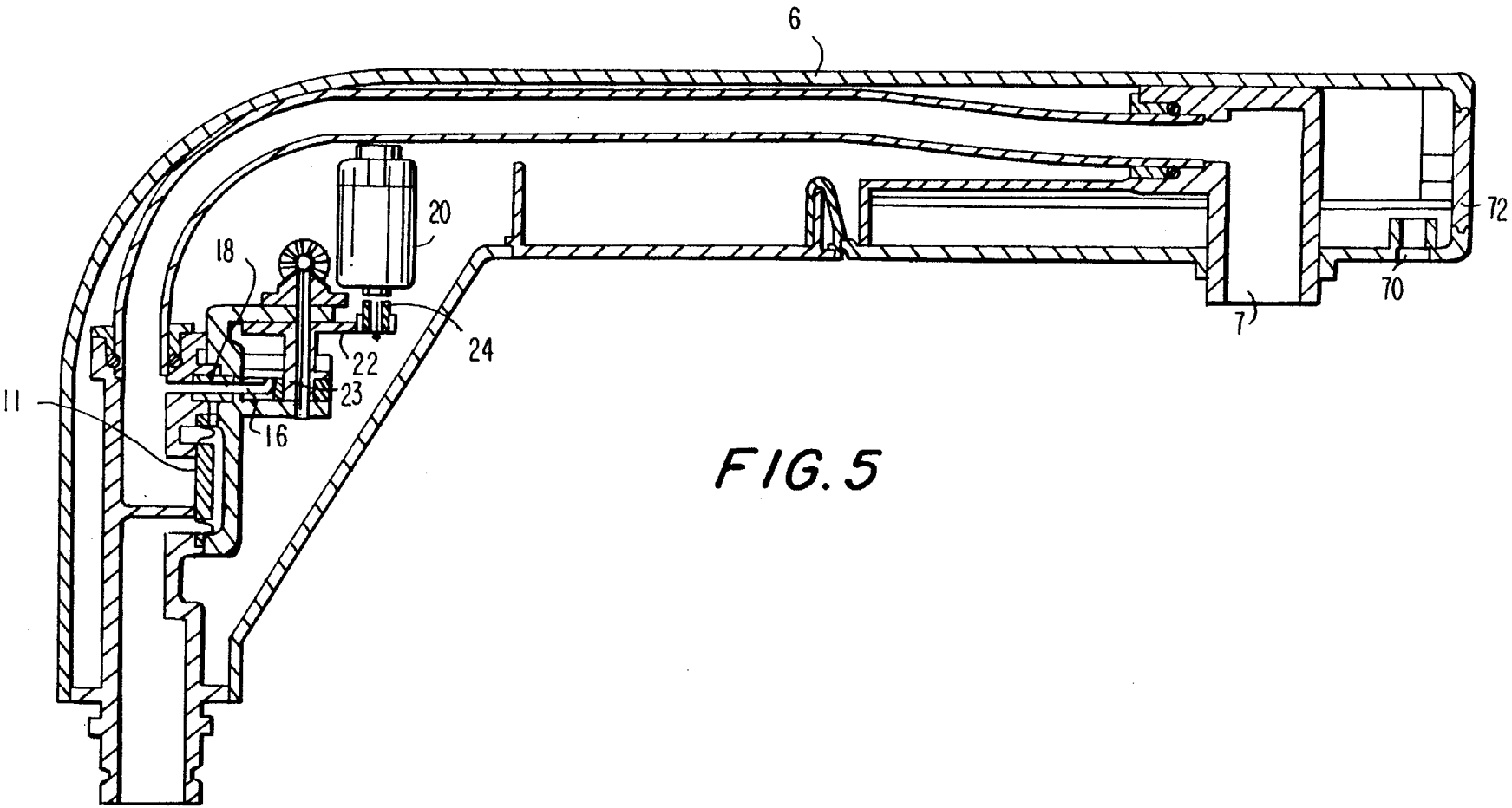
FIG. 5 illustrates a faucet where the assembly is mounted within the faucet.

FIG. 5 illustrates a faucet where the assembly is mounted within the faucet.

It is within the scope of the invention to arrange the assembly in further embodiments.

Figure 6:
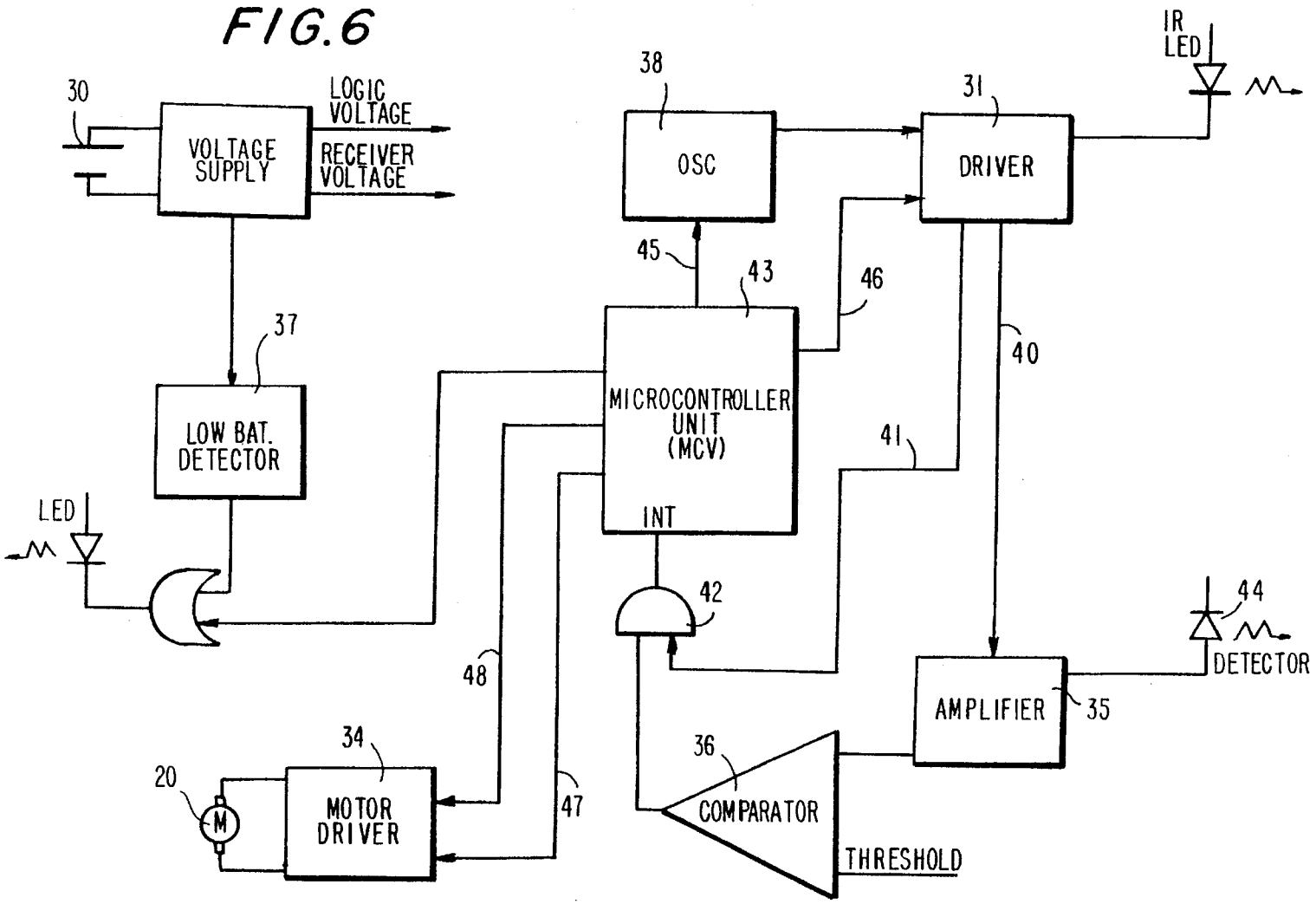
FIG. 6 is a diagramme of the electronic circuit.

The electrical and electronic operation is illustrated in FIG. 6. As mentioned before the voltage supply is fed from 9 volt battery 30 and generates current for the various circuits, for the driver circuit 31 and to the motor driver 34. Amplifier 35 and comparator 6 receive 9 volt current just before projecting a pulse. This period of time is necessary for the receiver to be able to receive generated pulse.

The low battery detector 37 also operates on these pulses for the same reason so as to save energy. All logic circuits receive a current between 3.5 to 5.5 volts required for the function.

The oscillator 38 (OSC) oscillates in an independent manner at a frequency wave of 4 hz and activates the pulses by means of driver 31 and the I.R. LED's. The control line 40 activates the amplifier 35 and comparator 36. The control line 41 controls the comparison between the generated pulse transmitted and the received pulse 42.

The driver 31 supplies current to the I.R. LED's for a short period of approximately 3 micro seconds at each time a "command" is received from the oscillator 38 or from the MCU 43.

The I.R. LED's source generate radiation, the wavelength of which is approximately 880 nanometer, the light intensity and pulse width as required by the current flowing therethrough.

The detector 44 is a silicon detector adapted to receive radiation generated in accordance with the wavelength of the sources.

The amplifier 35 is designed to amplify the short pulses received from detector 44. Special emphasis is given to the requirement that the amplifier will be connected to the current source for only a short period of time.

The comparator 36 is designed to compare the signal to the voltage threshold determined by the MCU. The threshold is being determined by the MCU according to the instantaneous mode of operation while open the scattering from the water stream has to be taken into account and to the surroundings. The faucet can "learn" its surroundings and adapt the threshold valve to it.

The constant presence of a highly reflective object in the field of view (like a white dish) will, for example, cause an increase of the threshold valve.

The gate enables the timing of the pulses which are received and amplified.

The MCU 43 is being activated each time a digital signal is received at its INT. When the MCU is activated it neutralizes the oscillator 38 by means of line 45 and drives the LEDs at a repetition rate much higher than in the usual mode of operation to verify the presence of an "activating object". The MCU calculates the statistics of the detected signals—a verification is declared only in the case that a reflected signal has been detected for each limited pulse. In such a case an "open" procedure is activated and an activating pulse is sent to the electric motor.

When the faucet is open the MCU continues to drive the LEDs at a high repetition rate. The "threshold learning mechanism" adapts the threshold to be just below the accumulated reflection signal from the activating object and the water stream. If no reflection signals are received for a certain period of time, a "close" procedure is implemented and a short pulse is sent via line 48 to which activate the motor to close the faucet.

The MCU then performs a procedure of adapting the threshold to the constant reflections from objects present in the detector field of view.

Figure 7:
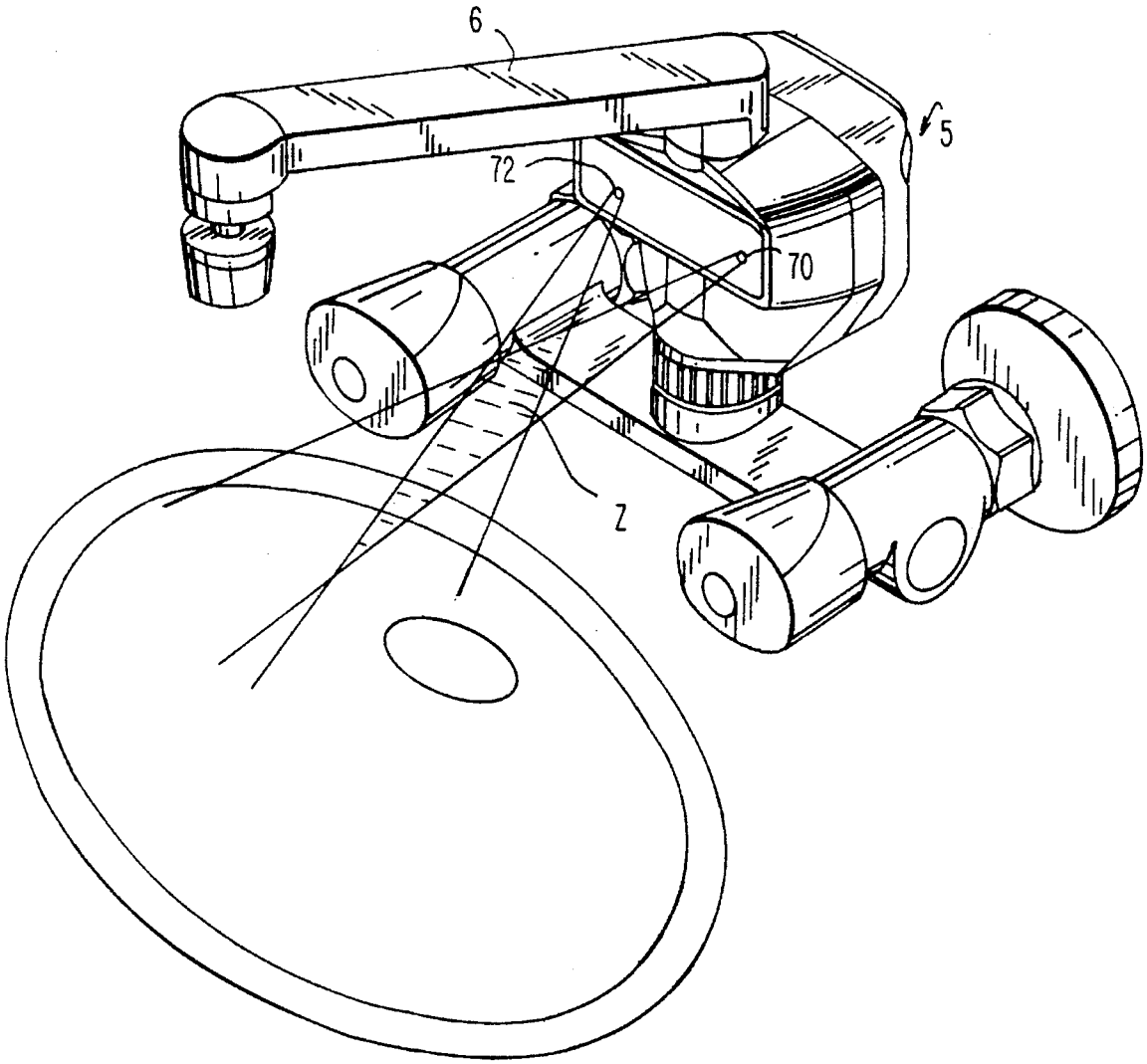
FIGS. 7 to 10 illustrate schematically the difference modes of the invention and the mounting of the IR transmeter and receiver.

As can be seen in FIG. 7 the IR transmitter 70 and receiver 72 are both mounted in body 5.

Due to the lateral separation between the transmitter and the receiver a geometrical overlap zone Z is defined. Only objects that enter into this zone Z will activate the water flow, as described above.

Figure 8:
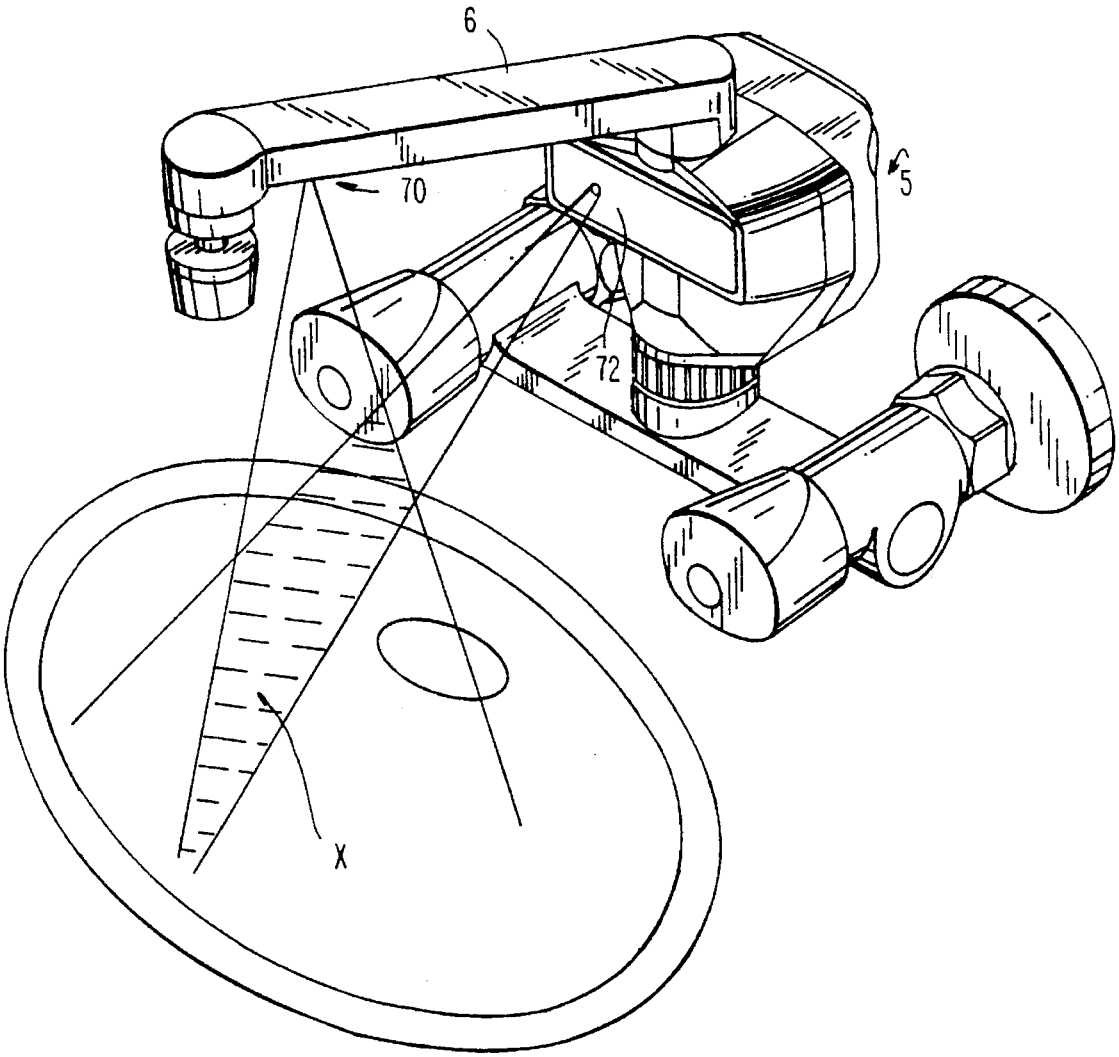

FIG. 8 illustrates a prefered embodiment. The infrared sensing means 70 installed on the spout and a receiver 72 equipped with an objective lens is mounted in the body. The radiation conus and the receiver field-of-view define an overlap volume X such that only objects inside this volume will scatter light into the receiver and activate the faucet.

Figure 9:
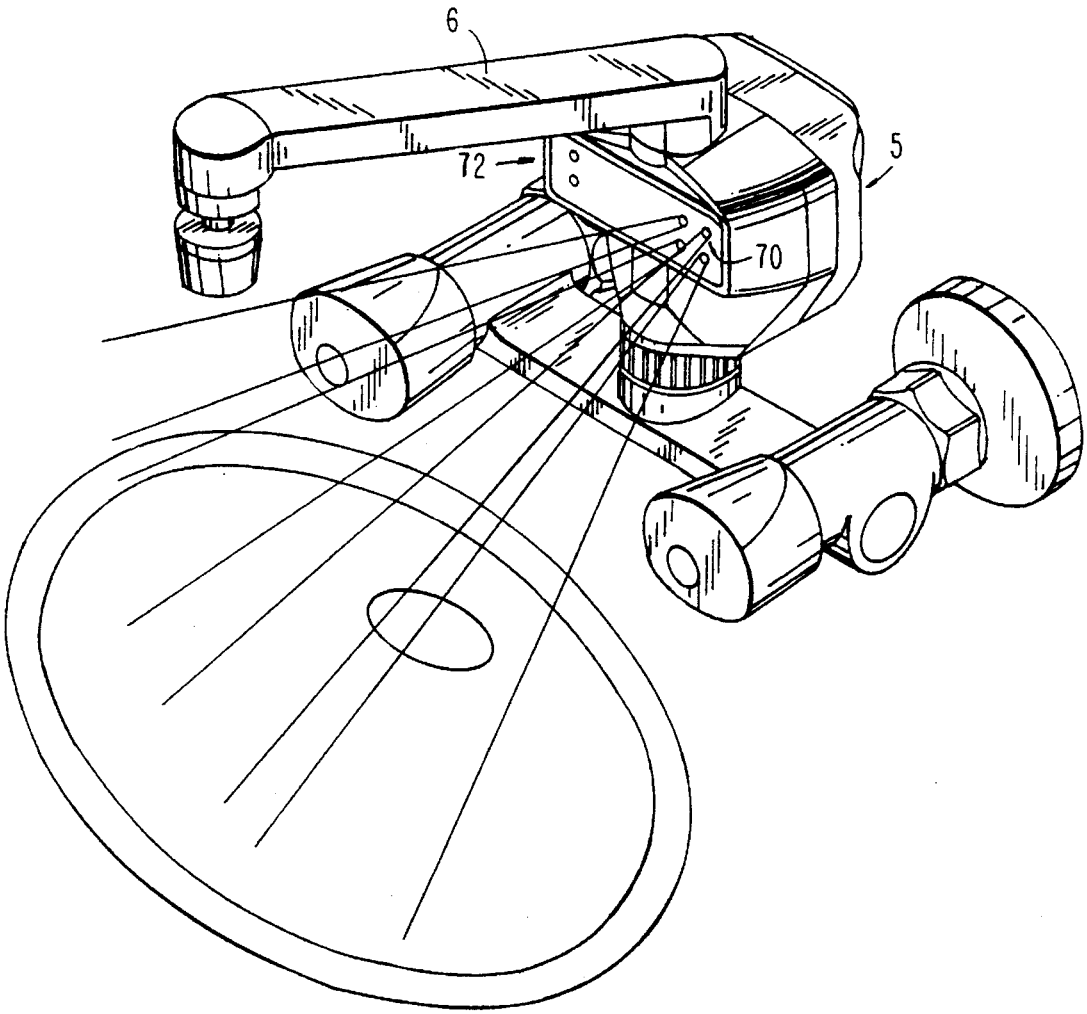

FIG. 9 illustrates a manner according to which a large activation volume X is defined and still a strict geometrical definition of this activation zone is maintained. A plurality of LEDs 70 and a plurality of eceivers are used to geometrically cover the required zone.

By employing the above embodiments the system could be used in different modes of operation as follows:

Automatic Mode

In this mode of operation an object inserted into the activation zone triggers the water flow. When this object is removed from the activation zone the water flow stops. This is the "normal" operation mode applicable for hand and dish washing.

Semi-Automatic Mode

In this mode an object inserted into the activation volume activates the water flow as above. The water flow does not stop when the object is removed from the zone. In order to stop the water flow object must penetrate the activation zone for the second time. This "on/off zone" may be localized in a region that is usually not accessible when performing usual dish washing tasks. The semi-automatic mode of operation is required when handling black or specular objects or when soaping the dishes or cleaning the basin.

Figure 10:
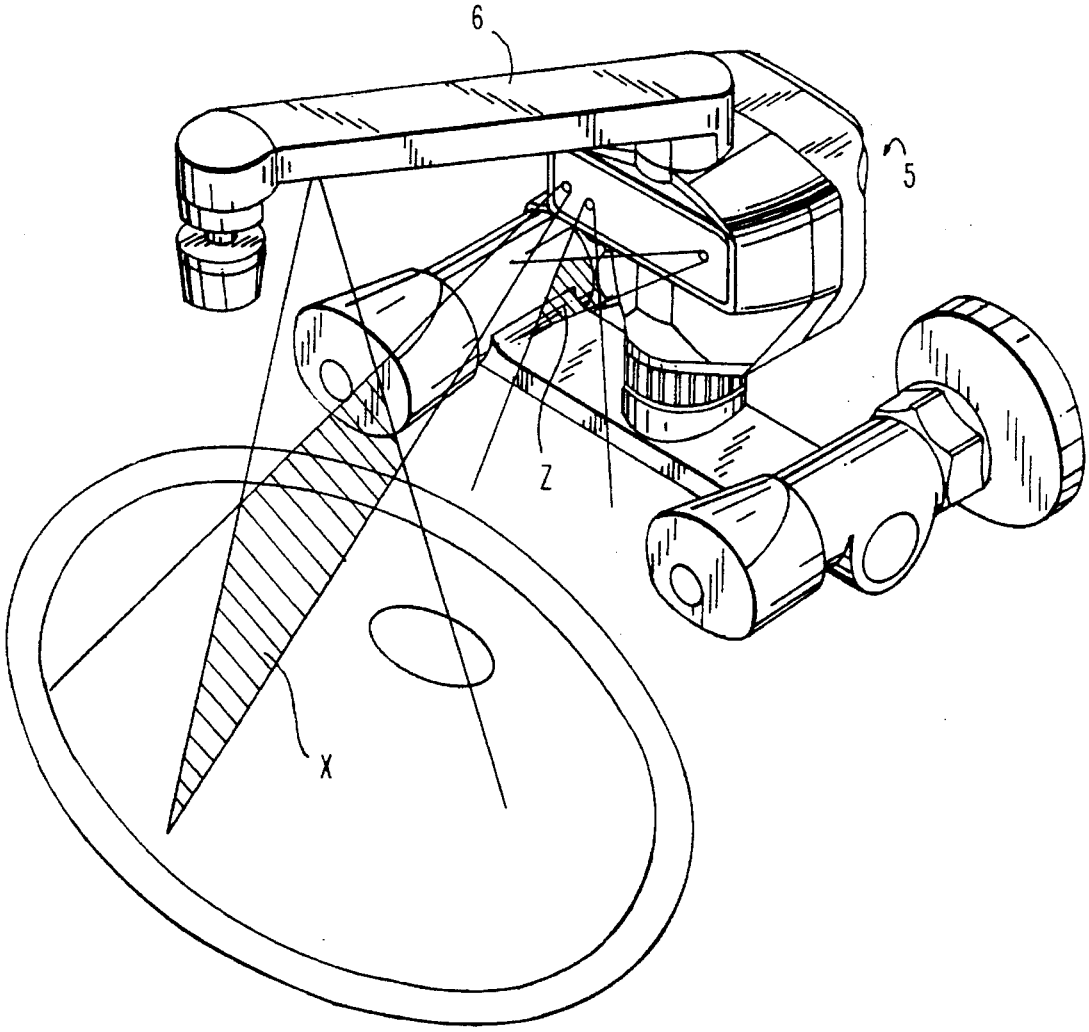

FIG. 10 relates to the prefered embodiment which employs a combination of the two above mentioned embodiments.

Usually both automatic and semi-automatic modes of operation are required for every faucet installed in a kitchen basin and sometimes in bath basins as well. The automatic mode is activated in the course of a hand or dish washing activities, the semi-automatic modes is chosen while saponizing dishes, cleaning the basin or washing black or specular dishes.

A special distinction between the activation zones for the two modes of operation is implemented: the volume beneath the faucet outlet X is used as the "automatic zone" while the volume near the faucet Z is used as the "semi-automatic" zone.

The system distinguishes between the two modes using one of the following means:

a. Separate LED—receiver a couple for each zone 70 and 71.

b. A common detector 72, 73 or a plurality of common detectors for the two zones and LEDs that have different pulse rates for each zone.

c. A common detector or a plurality of common detectors and LEDs that have identical pulse frequency. After dectecting a first echo the MCU activates the two (or more) LEDs sequentially and thus identifies the zone that has been activated.

Although the invention has been described with reference to certain embodiments the scope of the invention is set forth in the following claims:

I claim:

1. An electrically operated faucet of the type including:

a valve controlling a water supply;

an electrical drive for operating said valve between opened and closed positions;

a transmitter for transmitting a recognizable signal;

a receiver operative to receive said recognizable signal; and, electronic circuit means controlled by said receiver for actuating said electrical drive to move said valve from a valve closed and valve opened position in response to a received signal;

the improvement comprising;

means limiting said recognizable signal emitted by said transmitter to a path having a determined transverse cross-sectional area;

means limiting said receiver to viewing in a path a determined cross-sectional area;

said receiver being positioned with said path of said receiver intersecting said path of said transmitter and at an angle to said path of said transmitter;

whereby, in the absence of a reflective article interposed in said path of said transmitter at a specific range of distance from said transmitter, said receiver is incapable of viewing and receiving said recognizable signal; and, in the presence of a reflective article interposed in said path of said transmitter within said specific range of distances, said receiver can receive reflected said recognizable signals and activate said electrical drive in a direction to open said valve.

2. Assembly faucet as claimed in claim 1, wherein the assembly includes a pilot valve to facilitate the operation of said faucet's valve.

3. Assembly faucet as claimed in claim 1, wherein said IR transmitter and receiver are both mounted in the body of said faucet assembly.

4. Assembly faucet as claimed in claim 1, wherein said transmitter is mounted in said spout which the receiver is mounted in said body.

5. Assembly faucet as claimed in claim 1, wherein a plurality of receivers are used to cover a large activation volume.

6. Assembly faucet as claimed in claim 1, wherein a plurality of detectors are used having different pulse rates.

7. Assembly faucet as claimed in claim 1, wherein there is provided a mechanism for neutralizing of the automatic operation of the assembly.

8. Assembly faucet as claimed in claim 1, wherein said electronic circuit comprises in combination: a power source, an electric motor, a micro controller, an oscillator, a driver, a comparator and a plurality of IR transmitter and Receiver.

9. Assembly faucet as claimed in claim 8, wherein said oscillator oscillates at a frequency of 4 hz.

10. Assembly faucet as claimed in claim 8, wherein said driver supplies current to the IR LED's for a period of approx. 3 micro seconds.

11. Assembly faucet as claimed in claim 8, wherein said IR source generates radiation, the wave length of which is approximately 880 nanometers.

12. Assembly faucet as claimed in claim 8, wherein said detector is a silicon detector.

* * * * *